US006879105B2

(12) United States Patent
Yasui et al.

(10) Patent No.: US 6,879,105 B2
(45) **Date of Patent: *Apr. 12, 2005**

(54) ELECTRODE PLATE AND MANUFACTURING METHOD FOR THE SAME, AND GAS DISCHARGE PANEL HAVING ELECTRODE PLATE AND MANUFACTURING METHOD FOR THE SAME

(75) Inventors: Hideaki Yasui, Hirakata (JP); Kazuhiko Sugimoto, Ibaraki (JP); Keisuke Sumida, Hirakata (JP); Hiroyoshi Tanaka, Kyoto (JP); Shinya Fujiwara, Kyoto (JP); Hideki Marunaka, Kyoto (JP); Kazunori Hirao, Yao (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/609,041

(22) Filed: Jun. 27, 2003

(65) Prior Publication Data

US 2004/0095067 A1 May 20, 2004

Related U.S. Application Data

(62) Division of application No. 09/792,590, filed on Dec. 4, 2000, now Pat. No. 6,603,262.

(30) Foreign Application Priority Data

Dec. 9, 1999 (JP) ..... 11-350301

(51) Int. Cl.[7] ..... H01J 17/49

(52) U.S. Cl. ..... 313/582; 313/585; 313/586; 313/587; 313/495; 313/496; 313/497; 445/24; 345/37; 345/60

(58) Field of Search ..... 313/582–587, 313/495–497; 445/24

(56) References Cited

U.S. PATENT DOCUMENTS 3,962,597 A * 6/1976 Clark et al. ..... 313/318.01
5,548,186 A * 8/1996 Ota ..... 313/583
5,800,232 A * 9/1998 Miyazaki ..... 313/585

(Continued)

FOREIGN PATENT DOCUMENTS

JP 3-101031 4/1991
JP 4-56039 2/1992
JP 5-266801 10/1993

(Continued)

OTHER PUBLICATIONS

Charles, H. K., Electrical Interconnection, Electronic Materials Handbook vol. 1, pp 224–236.*

*Primary Examiner*—Nimeshkumar D. Patel
*Assistant Examiner*—Sikha Roy

(57) ABSTRACT

An electrode plate, a method of manufacturing the same, a gas discharge panel using an electrode plate, and a method of manufacturing the same are provided by incorporating a relatively simple structure, which can keep electrodes formed on a plate from peeling or becoming misaligned. In the electrode plate, at least one electrode is formed and adhered to a main surface of a plate by a thick film or thin film formation method, wherein of all ends of the electrode, at least an end opposite to an end at a power supply point is adhered to the main surface of the plate with stronger adhesion than the other parts of the electrode. When this electrode plate is used as a front panel glass having a plurality of pairs of display electrodes in a gas discharge panel, at least an end of each bus line opposite to an end at a power supply point is firmly adhered to the surface of the front panel glass, thereby keeping the bus lines formed on respective transparent electrodes from warping and peeling away or becoming misaligned. Such a gas discharge panel can deliver excellent display performance.

3 Claims, 7 Drawing Sheets

U.S. PATENT DOCUMENTS

| | | | | | |
|---|---|---|---|---|---|
| 5,909,083 | A | * | 6/1999 | Asano et al. | 264/614 |
| 5,962,970 | A | * | 10/1999 | Yokoi et al. | 313/505 |
| 6,118,214 | A | * | 9/2000 | Marcotte | 313/582 |
| 6,344,714 | B1 | * | 2/2002 | Su et al. | 313/582 |

FOREIGN PATENT DOCUMENTS

| | | | | |
|---|---|---|---|---|
| JP | 9-245653 | | 9/1997 | |
| JP | 10302642 | A | * 11/1998 | H01J/11/02 |
| JP | 11283511 | A | * 10/1999 | H01J/17/04 |

* cited by examiner

ELECTRODE PLATE AND MANUFACTURING METHOD FOR THE SAME, AND GAS DISCHARGE PANEL HAVING ELECTRODE PLATE AND MANUFACTURING METHOD FOR THE SAME

This is the divisional application of U.S. Ser. No. 09/792,590 filed on Dec. 4, 2000, now U.S. Pat. No. 6,603,262.

BACKGROUND OF THE INVENTION

1. Field of the Invention

The present invention relates to an electrode plate and its manufacturing method, and a gas discharge panel having an electrode plate and its manufacturing method.

2. Related Art

An electrode plate, in which electrodes are formed by laminating transparent electrodes made of indium tin oxide (ITO) or the like and bus lines made of metal (Ag or Cr—Cu—Cr) or the like on a surface of a plate such as a glass plate, is being used in a number of applications such as a front panel having display electrodes in a gas discharge panel.

A gas discharge panel, typified by a plasma display panel (PDP), is a type of flat display panel (FDP) that lends itself to use in a large-screen device. 50-inch class devices have already been commercialized using PDPs.

In a PDP, two thin glass plates (front panel glass and back panel glass) are placed in opposition to each other, with barrier ribs being interposed in between. Phosphor layers are formed in the gaps between neighboring barrier ribs. Discharge gas is filled in the discharge spaces present between the two glass plates, and the two glass plates are sealed together so as to be airtight. A plurality of pairs of display electrodes are disposed on the surface of the front panel glass facing the phosphor layers. By initiating discharge of gas in each of the discharge spaces, ultraviolet light is produced.

FIG. 8A is a perspective view showing an example electrode plate that includes a front panel glass 21 and a pair of display electrodes 22 and 23 disposed on the front panel glass 21. FIG. 8B is a top view of the pair of display electrodes 22 and 23, looking down in a direction z. As illustrated, the display electrodes 22 and 23 are each extending in such a direction (i.e. direction y) as to intersect with barrier ribs 30. These display electrodes 22 and 23 are made up of transparent electrodes 220 and 230 which are strip-shaped ITO films, and bus lines (bus electrodes) 221 and 231 of Ag having high conductivity which are deposited respectively on the transparent electrodes 220 and 230. The areas between neighboring barrier ribs 30 are cells 340, in which phosphor layers (not illustrated) in each of the three colors red (R), green (G), and blue (B) are formed. In the cells 340, ultraviolet light produced between the display electrodes 22 and 23 collides with and excites the phosphor layers, as a result of which visible light is emitted and put to use in screen display. In ordinary PDPs, a plurality of cells such as the cells 340 are aligned for a plurality of pairs of display electrodes such as the pair of display electrodes 22 and 23, thereby forming a matrix.

Here, the display electrode 22 (23) is formed by applying a paste containing a conductive material, an organic material, and a glass substance to the surface of the front panel glass 21 (the surface of the transparent electrode 220 (230) in the case of the bus line 221 (231)) in a predetermined pattern by screen printing (a thin film or thick film formation method), and then firing the result.

However, when the display electrode 22 (23) is formed on the front panel glass 21 according to this manufacturing method, the display electrode 22 (23) may become misaligned or part of the display electrode 22 (23) (such as the bus line 221 (231)) may peel away from the surface to which it has been adhered. These problems arise due to the following main reasons.

First, the adhesion between the transparent electrode 220 (230) or the bus line 221 (231) and the surface to which it is adhered (i.e. the surface of the front panel glass 21 or the surface of the transparent electrode 220 (230)) depends on an affinity at an interface between the two members. If the affinity is insufficient, the adhesion between them is not strong. Accordingly, when the display electrode 22 (23) suffers vibrations created during the process of firing the bus line material or during transportation in the subsequent process of forming a dielectric layer over the formed display electrode 22 (23), the above problems are likely to occur.

Second, the display electrode 22 (23) is formed by firing a paste including a conductive material, an organic material, and a glass substance, as noted earlier. In this firing process, the organic material is destroyed, which causes the display electrodes 22 (23) to slightly shrink in volume. Since this destruction of the organic material occurs gradually from the surface of the paste, the transparent electrode 220 (230) or the bus line 221 (231) is acted upon by stress that induces warping (deformation stress), and as a result becomes prone to peel away from the surface to which it is adhered. In particular, the outermost end of the bus line 221 (231) in the direction in which it extends (the direction y in FIG. 8) tends to peel away from the surface of the transparent electrode 220 (230). The inventors of this patent application have found that such phenomenon is frequently observed when the bus line 221 (231) contains Ag.

These problems may arise even if a method other than screen printing, such as sputtering, is employed in the formation of the bus line 221 (231). In the sputtering method, due to factors such as the internal atmospheric pressure and the plate temperature (the temperature of the front panel glass 21) during sputtering, stress acts on a film of bus line material which is being developed. The developed film is then etched using photolithography or the like to form the bus line 221 (231). During this etching, the film tends to become misaligned or peel away from the transparent electrode 220 (230), due to the above stress.

Similar problems are seen in electrode plates of other flat panel display (FPD) technologies (e.g. a front panel glass having display electrodes in a liquid crystal display). Immediate solutions to these problems are crucial for the development of efficient FPDs.

SUMMARY OF THE INVENTION

The present invention aims to provide an electrode plate, its manufacturing method, a gas discharge panel using an electrode plate, and its manufacturing method, by incorporating a relatively simple structure which can prevent peeling or misalignment of electrodes formed on a plate.

The stated object can be fulfilled by an electrode plate for use in a flat panel display, including a plate and at least one electrode which is formed and adhered to at least one main surface of the plate using a thin film formation method or a thick film formation method, wherein, of an end area of the electrode at a power supply point and an end area of the electrode opposite to the end area at the power supply point, at least the opposite end area of the electrode is adhered to the main surface of the plate with stronger adhesion than other areas of the electrode.

With this construction, of the two ends of the electrode, at least the end opposite to the end at the power supply point is firmly bonded to the main surface of the plate. As a result, the electrode is kept from warping and peeling away from the plate, or becoming displaced from a predetermined position on the plate.

Here, an adhesive may be used to strengthen the adhesion between at least the opposite end of the electrode and the main surface of the plate. Also, one or more surface treatments such as sandblasting, ultraviolet irradiation, or plasma irradiation may be conducted on part of the main surface of the plate to which at least the opposite end of the electrode is to be adhered, to strengthen the adhesion.

Here, a glass plate is easy to get, and therefore desirable for use as the plate. The glass plate may be coated with a film of silicon oxide or nitrogen oxide.

The electrode plate of the invention may be used in a gas discharge panel, as a front panel glass on which a plurality of pairs of display electrodes are formed.

The stated object can also be fulfilled by a gas discharge panel equipped with the above front panel glass having the plurality of pairs of display electrodes. In such a gas discharge panel, the plurality of pairs of display electrodes are accurately aligned, so that excellent display performance can be achieved.

The stated object can also be fulfilled by an electrode plate manufacturing method for use in a flat panel display, including an electrode forming step for forming at least one electrode and adhering the electrode to at least-one main surface of a plate using a thin film formation method or a thick film formation method, wherein in the electrode forming step, of an end area of the electrode at a power supply point and an end area of the electrode opposite to the end area at the power supply point, at least the opposite end area of the electrode is adhered to the main surface of the plate with stronger adhesion than other areas of the electrode.

The stated object can also be fulfilled by a gas discharge panel manufacturing method that forms a plurality of display electrodes on a front panel glass according to the above electrode plate manufacturing method.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENT(S)

1. First Embodiment 1.1. Construction of a PDP

Figure 1:
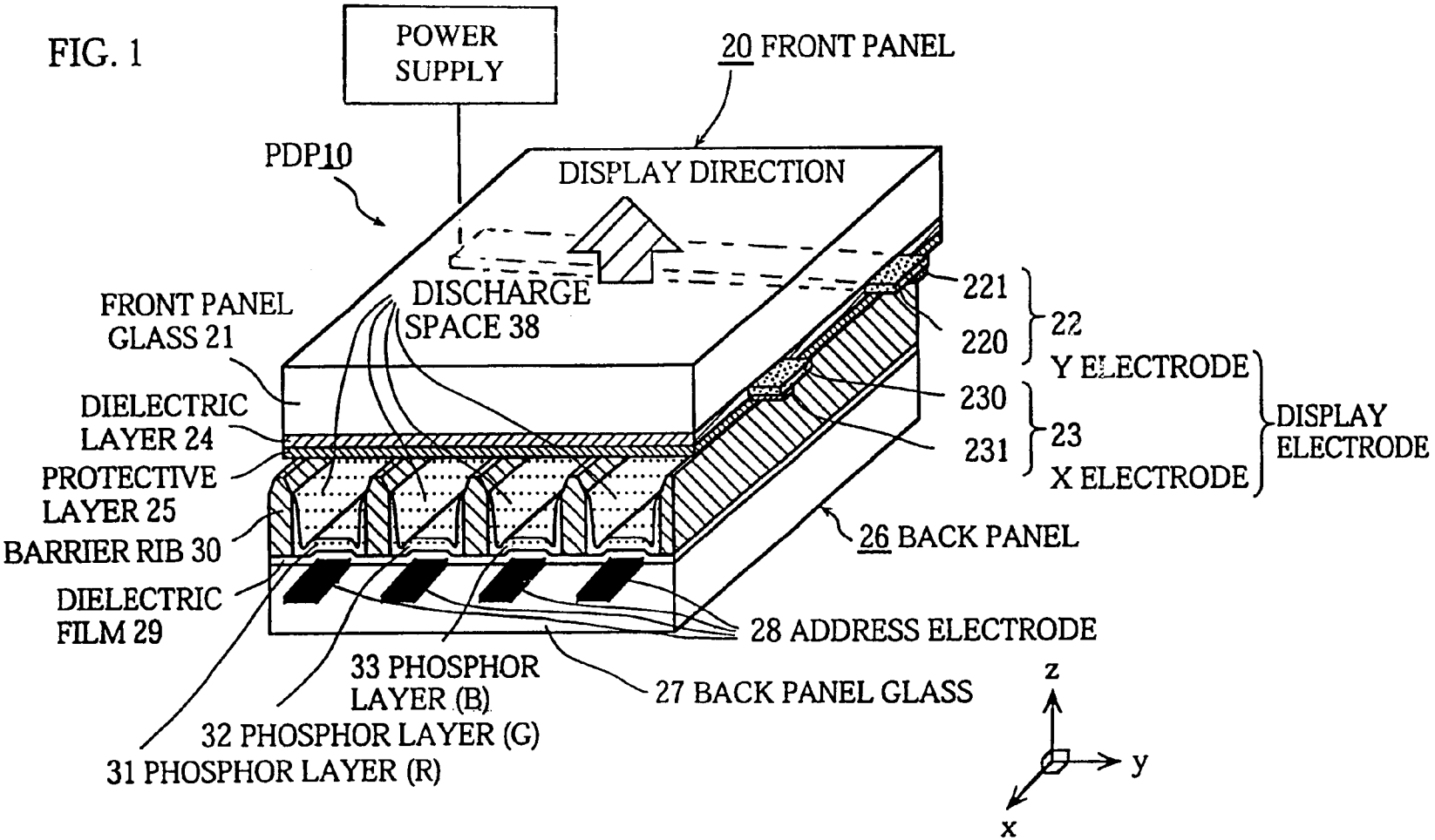
FIG. 1 is a partial perspective and sectional view of a main construction of a PDP according to a first embodiment of the invention.

FIG. 1 is a partial perspective and sectional view showing a main construction of a surface discharge AC plasma display panel 10 (hereafter simply referred to as "PDP 10"); according to the first embodiment of the invention. In the drawing, a direction z corresponds to the depth of the PDP 10, and a plane xy corresponds to a plane parallel with the panel surface of the PDP 10. As an example, the PDP 10 is built in a size that complies with the 42-inch class VGA standards, though other sizes are also applicable.

As shown in the drawing, the structure of the PDP 10 can be broadly divided into a front panel 20 and a back panel 26 which are set facing each other.

On the inner surface of a front, panel glass 21 that forms the base of the front panel 20, a plurality of pairs of display electrodes 22 and 23 (each pair is made up of an X electrode 23 and a Y electrode 22) are arranged in the direction x-such that each electrode extends in the direction y. Each pair of display electrodes 22 and 23 are formed by placing strip-shaped transparent electrodes 220 and 230 having a thickness of 0.1 $\mu$m and a width of 150 $\mu$m on the surface of the front panel glass-21, and then placing bus lines 221 and 231 having a thickness of 7 $\mu$m and a width of 95 $\mu$m respectively on the transparent electrodes 220 and 230. Also, each pair of display electrodes 22 and 23 are electrically connected to a panel drive circuit (not shown in the figure), near one side of the front panel glass 21 in the width direction (the direction y). Here, the Y electrodes 22 are connected to the panel drive circuit together, whereas the X electrodes 23 are connected to the panel drive circuit separately. Accordingly, when power is supplied from the panel drive circuit to the Y electrodes 22 and a particular X electrode 23, surface discharge (sustain discharge) occurs in a gap (about 80 $\mu$m wide) between the X electrode 23 and a Y electrode 22 which is paired with the X electrode 23.

Each of the X electrodes 23 also acts as a scan electrode, and generates write discharge (address discharge) with an address electrode 28.

A dielectric layer 24 with a thickness of about 30 $\mu$m is coated over the surface of the front panel glass 21 on which the plurality of pairs of display electrodes 22 and 23 have been arranged, so as to cover the plurality of pairs of display electrodes 22 and 23. A protective layer 25 with a thickness of about 1.0 $\mu$m is then coated over the surface of the dielectric layer 24.

On the inner surface of a back panel glass 27 which forms the base of the back panel 26, a plurality of address electrodes 28 having a thickness of 5 $\mu$m and a width of 60 $\mu$m are arranged in the direction y such that each electrode extends in the direction x. Here, adjacent address-electrodes 28 have a fixed pitch (about 150 $\mu$m). The plurality of address electrodes 28 are separately connected to the panel drive circuit so as to be supplied with power individually. Accordingly, when a particular address electrode 28 is supplied with power, address discharge occurs between the address electrode 28 and a particular. X electrode 23.

A dielectric film 29 with a thickness of about 30 $\mu$m is coated over the surface of the back panel glass 27 so as to cover the plurality of address electrodes 28. Then a plurality of barrier ribs 30 having a height of about 150 μm and a width of about 40 μm are arranged on the surface of the dielectric film 29 so as to extend in the direction x, in accordance with the pitch between neighboring address electrodes 28.

Red (R), green (G), and blue (B) phosphor layers 31, 32, and 33 are applied in turn in the direction y, to the sides of adjacent barrier ribs 30 and the surface of the dielectric film 29 therebetween.

The front panel 20 and the back panel 26 are positioned so that the plurality of address electrodes 28 and the plurality of pairs of display electrodes 22 and 23 intersect with each other. The front panel 20 and the back panel 26 are then bonded to each other along their outer edges, as a result of which the front and back panels 20 and 26 are sealed together.

Figure 8A:
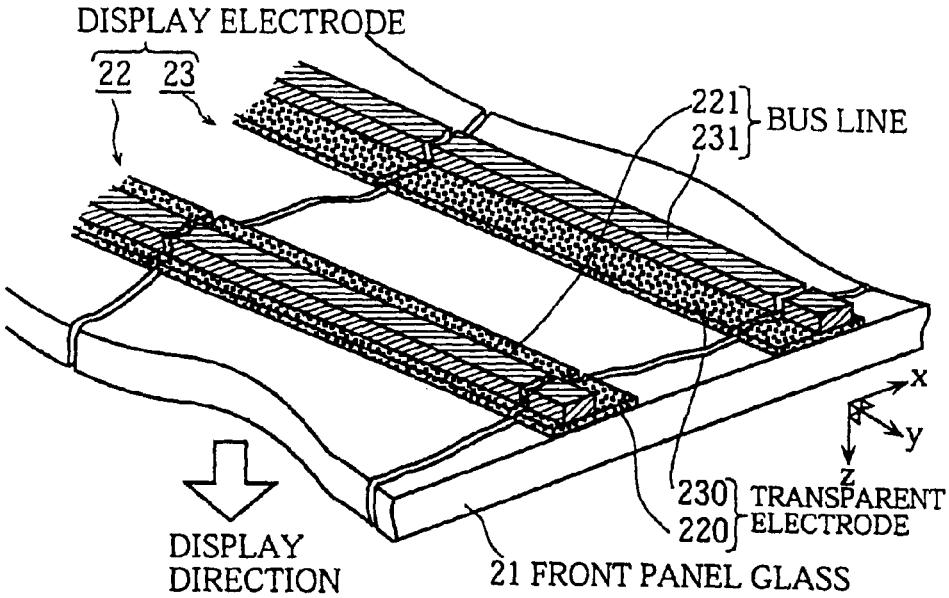
FIG. 8A is a partial perspective view of display electrodes in a conventional PDP.
Figure 8B:
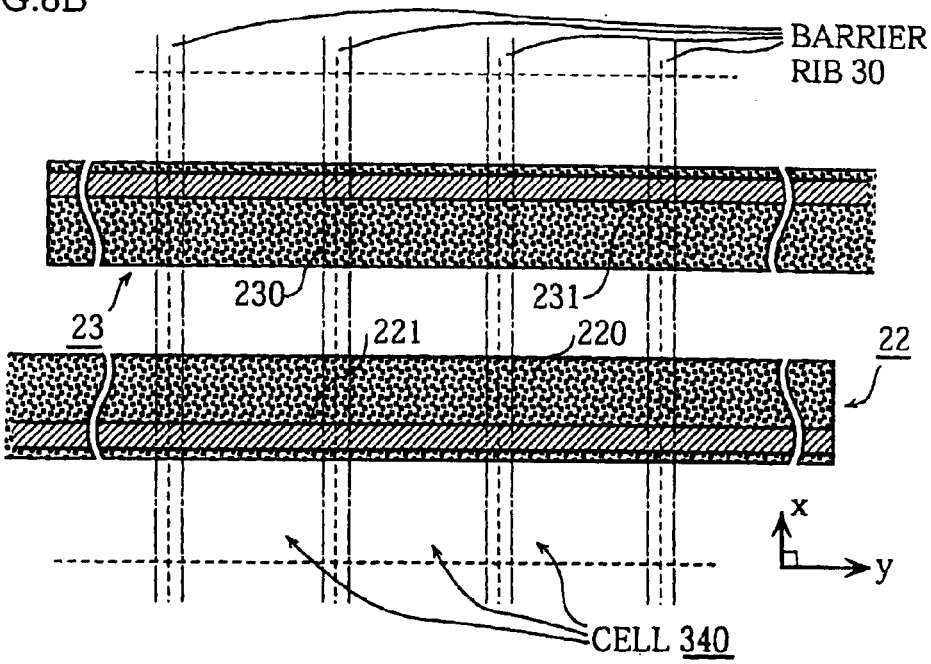
FIG. 8B is a partial top view of the display electrodes shown in FIG. 8A.

A discharge gas (filler gas) made of one or more inert gases selected from He, Xe, and Ne is filled in between the front and back panels 20 and 26, at a predetermined pressure (normally about 500–766 Torr). The spaces between neighboring barrier ribs 30 are discharge spaces 38. Also, the areas within the discharge spaces 38 where the plurality of pairs of display electrodes 22 and 23 intersect with the plurality of address electrodes 28 are cells for image display (corresponding to the cells 340 shown in FIG. 8B). As an example, the cell pitch is about 1080 μm in the direction x, and about 360 μm in the direction y.

Such a constructed PDP 10 is driven in the following manner. First, a pulse voltage is applied from the pulse drive circuit to certain address electrodes 28 and certain X electrodes 23 to induce address discharge. After this, a pulse voltage is applied to certain pairs of display electrodes 22 and 23 to induce sustain discharge, as a result of which ultraviolet light of a short wavelength (a resonance line centered on a wavelength of around 147 nm) is emitted. The ultraviolet light excites phosphor layers 31–33 which emit light in the respective colors, thereby producing an image display.

1.2. Characteristics and Effects of the First Embodiment

Conventionally, while firing is being performed in the formation of the display electrode 22 (23) on the front panel glass 21 or white the display electrode 22 (23) is being transported in the subsequent formation of the dielectric layer 24 over the display electrode 22 (23), the display electrode 22 (23) tends to become misaligned or part of the display electrode 22 (23) (such as the bus line 221 (231)) tends to peel away.

These problems can be attributed to a factor that the adhesion between the transparent electrode 220 (230) or the bus line 221 (231) and the surface to which it is adhered (the surface of the front panel glass 21 or the surface of the transparent electrode 220 (230)) depends on an affinity between the two members. If the affinity is not sufficient, strong adhesion cannot be ensured between them. In other words, lack of affinity between the transparent electrode 220 (230) and the front panel glass 21 or between the bus line 221 (231) and the transparent electrode 220 (230) causes insufficient adhesion between them, and tends to give rise to the aforementioned problems when the display electrode 22 (23) suffers vibrations created by transportation during the manufacturing operation. If the dielectric layer 24 and the protective layer 25 are formed on the front panel glass 21 over such misaligned or peeling display electrodes 22 and 23, the manufactured PDP 10 will end up being unable to perform proper discharge (address discharge and surface discharge), which results in a decrease in image display performance.

Figure 2:
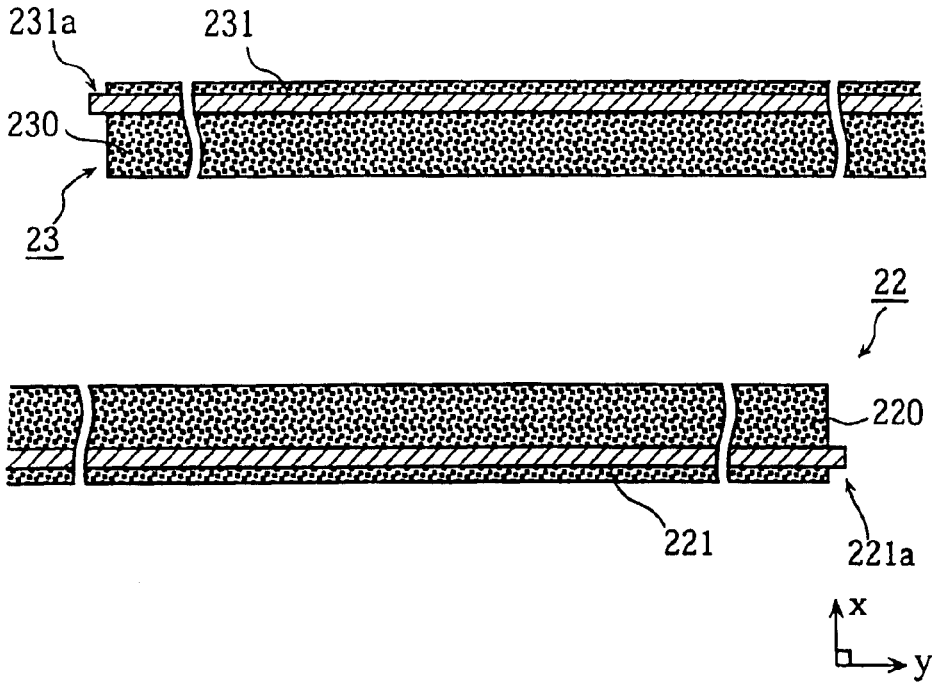
FIG. 2 is a partial top view of display electrodes in the first embodiment.

To overcome the problems, in the first embodiment the end (i.e. an end 221*a* (231*a*) shown in FIG. 2) of the bus line 221 (231) which is opposite to the end at the power supply point is extended beyond the transparent electrode 220 (230) and is adhered to the surface of the front panel glass 21. Here, the length of the extended end 221*a* (231*a*) is 30 μm. In general, the affinity between the bus line 221 (231) and the front panel glass 21 is higher than the affinity between the transparent electrode 220 (230) and the front panel glass 21, and also higher than the affinity between the bus line 221 (231) and the transparent electrode 220 (230). This property is exploited in the PDP 10 of the present embodiment in which the end 221*a* (231*a*) is firmly adhered to the front panel glass 21 both before and after the firing of the bus line 221 (231). In so doing, the display electrode 22 (23) is kept from becoming misaligned or peeling away from the surface of the front panel glass 21.

In other words, when the end 221*a* (231*a*) of the bus line 221 (231) is bonded to the front panel glass 21, there is no danger that the bus line 221 (231) may peal away from the transparent electrode 220 (230) and develop a short circuit with another display electrode, or that the distances between neighboring display electrodes may become ununiform which causes an uneven, poor-quality display. Therefore, excellent display performance with balanced light emission in each of the colors can be obtained.

Here, to strengthen the bond of the end 221*a* (231*a*) to the front panel glass 21, the end 221*a* (231*a*) may be made to contain a higher proportion of glass than the other parts of the bus line 221 (231).

Also, the transparent electrode 220 (230) and the bus line 221 (231) may be each made up of a plurality of separate parts (for example, the bus line 221 (231) is disposed on the transparent electrode 220 (230) which is composed of a plurality of separate parts arranged in a spotting pattern, so as to be in electrical contact with the transparent electrode 220 (230)).

The inventors of the present application conducted a test on the state of the display electrode 22 (23), by setting the length of the end 221*a* (231*a*) of the bus line 221 (231) in the direction y respectively at 30 μm, 60 μm, and 100 μm. As a result, neither peeling nor misalignment was observed in any of the cases. Given that the width of the bus line 221 (231) is 95 μm in this embodiment, it can be said that the length of the end 221*a* (231*a*) in the direction y need be at least about one-thirds the width of the bus line 221 (231) (i.e. approximately 30 μm).

1.3. Supplemental Remarks about Adhesion of the Bus Line to the Transparent Electrode and the Front Panel Glass An explanation about the adhesion of the bus line to the transparent electrode or to the front panel glass is given below.

Generally, adhesion between two different substances is correlated with a contact angle of one substance to the other, namely, wettability. This correlation between the adhesion and the contact angle is mostly maintained even when one of the substances is a liquid and the wetting behavior of the liquid on a solid surface changes with time (i.e. the liquid dries gradually on the solid surface).

When this correlation is applied to the adhesion of the bus line to the transparent electrode or to the front panel glass, then it can be said that the smaller the contact angle of the bus line material to the front panel glass (that is, the higher the wettability of the front panel glass to the bus line material), the surface of the bus line adhered to the front panel glass is less prone to peeling or misalignment (that is, the adhered surface has a high affinity for the front panel glass). The same thing can be said with regard to the correlation between any electrode material which is applied by screen printing (a thick film or thin film formation method) and a plate on which the electrode material is applied.

Figure 7A:
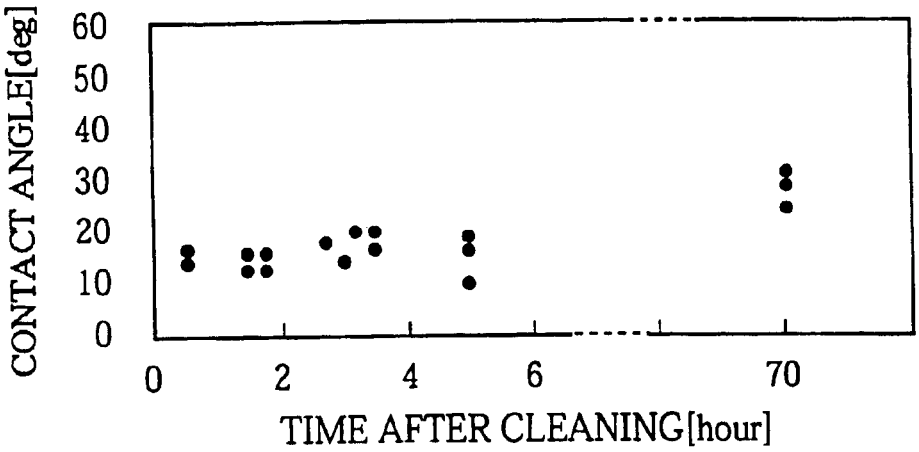
FIG. 7A is a characteristic view showing a change in wettability of a glass plate over time.
Figure 7B:
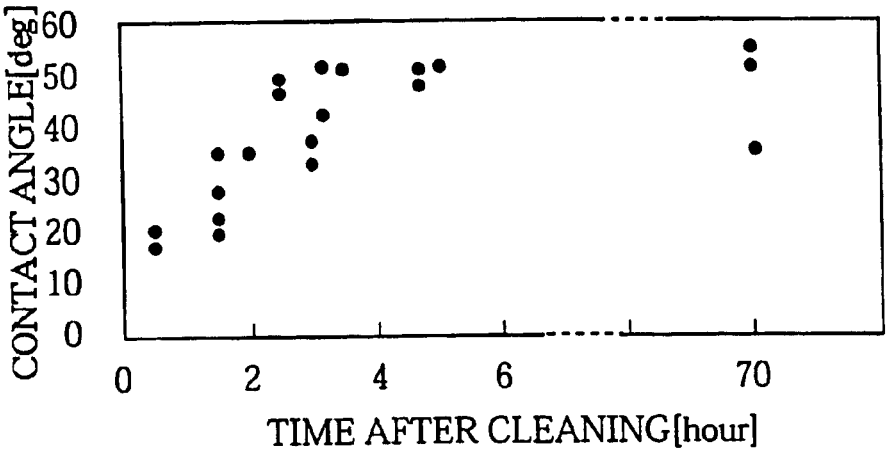
FIG. 7B is a characteristic view showing a change in wettability of a transparent electrode over time.

FIG. 7A is a graph showing how the contact angle of the bus line material (including Ag, an organic material, and a plasticizer) which is dropped onto the front panel glass changes with time. FIG. 7B is a graph showing how the contact angle of the bus line material dropped onto the transparent electrode changes with time. These graphs show results of experiments which were conducted using several sample bus line materials with slightly different components. In both FIGS. 7A and 7B, the contact angle increases with time. This is probably because the surface of the bus line material is gradually contaminated due to absorption of water or adhesion of foreign materials. These drawings show that the contact angle of the bus line material is generally smaller on the front panel glass than on the transparent electrode. This demonstrates that the bus line material has relatively excellent adherence to the front panel glass.

1.4. Variation 1-1

Figure 3:
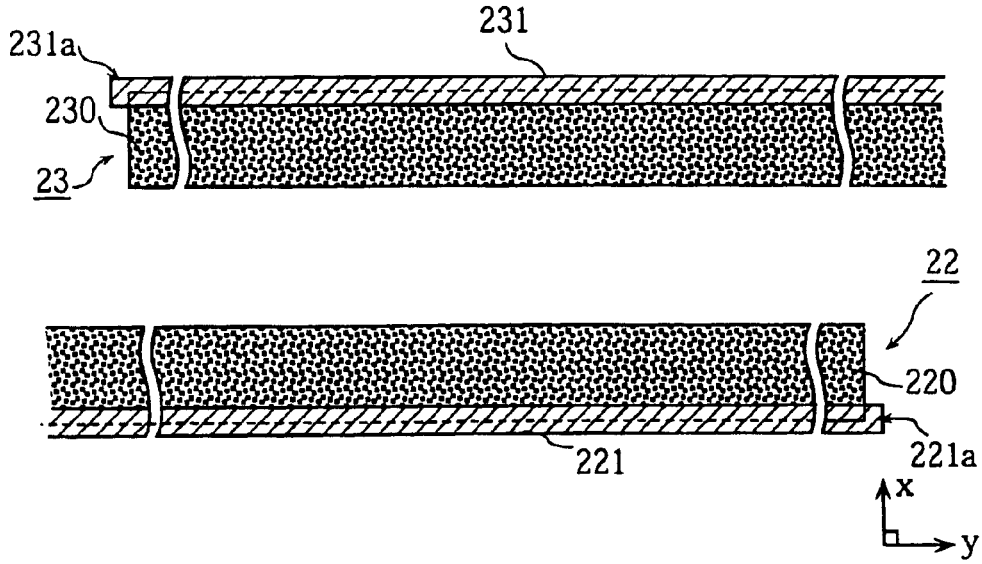
FIG. 3 is a partial top view of display electrodes in a variation 1-1.

The following is an explanation on a variation 1-1 of the first embodiment. In the first embodiment, the end 221*a* (231*a*) of the bus line 221 (231) opposite to the end at the power supply point is extended beyond the transparent electrode 220 (230) and adhered to the surface of the front panel glass 21 (see FIG. 2). In the variation 1-1, in addition to the end 221*a* (231*a*) of the bus line 221 (231), one side of the bus line 221 (231) is adhered to the surface of the front panel glass 21, as shown in FIG. 3.

With this structure, the same effects as the first embodiment can be achieved. Furthermore, since one side of the bus line 221 (231) is firmly bonded to the front panel glass 21 along the length direction (the direction y); peeling or misalignment of the transparent electrode 220 (230) and the bus line 221 (231) can be suppressed more reliably.

Though the bus line 221 (231) is set to be longer than the transparent electrode 220 (230) in this variation, peeling or misalignment can be suppressed even if the length of the bus line 221 (231) is equal to or smaller than the transparent electrode 220 (230).

Also, a certain degree of effectiveness can be expected even when the side of the bus line 221 (231) is only partially bonded to the front panel glass 21.

1.5. Other Variations

Figure 4:
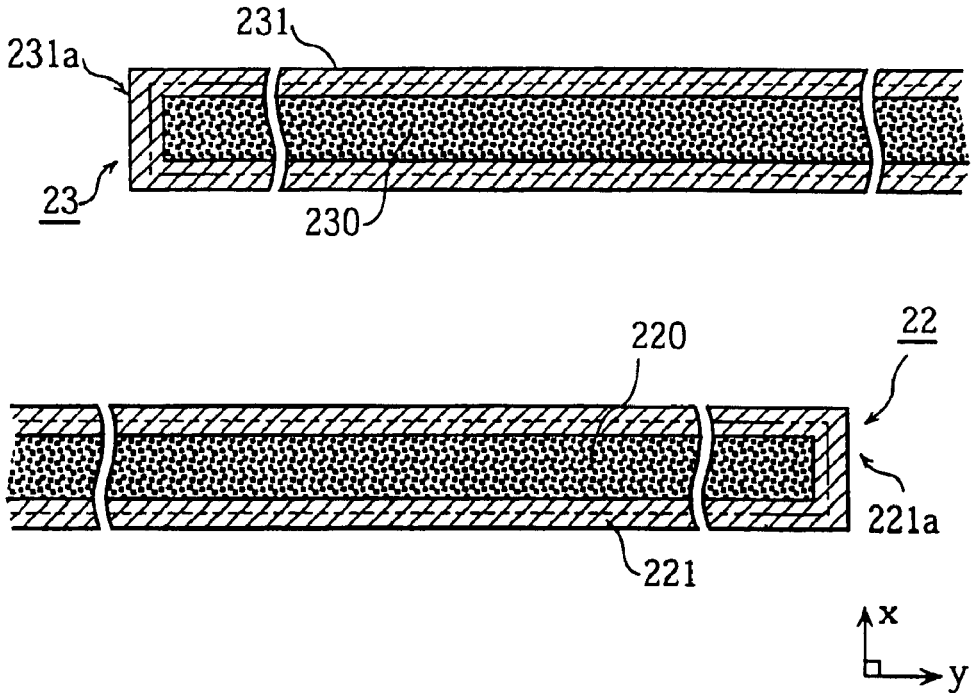
FIG. 4 is a partial top view of display electrodes in a variation 1-2.

FIG. 4 is a partial top view showing display electrodes in a variation 1-2 of the first embodiment. In this variation 1-2, the bus line 221 (231) is formed so as to be astride the transparent electrode 220 (230) and the front panel glass 21 along the entire edges of the transparent electrode 220 (230). With this structure, the effects obtained in the variation 1-2 are further improved.

The inventors conducted a test on the state of the display electrode 22 (23), by setting the width of the side portion of the bus line 221 (231) in the direction x which is adhered to the front-panel glass 21, respectively at 10 $\mu$m, 20 $\mu$m, and 30 $\mu$m. As a result, neither peeling nor misalignment was seen in any of the cases. Accordingly, it is believed that the width of the side portion of the bus line 221 (231) adhered to the front panel glass 21 is preferably 10 $\mu$m or larger.

Figure 5A:
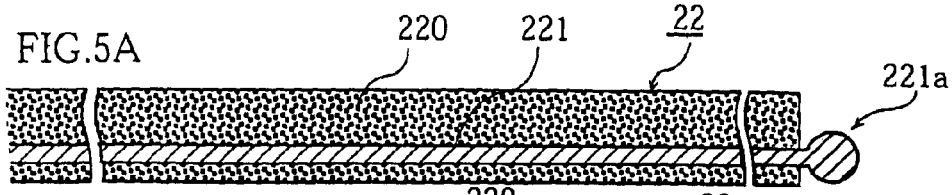
FIGS. 5A–5E are partial top views of display electrodes in other variations 1-3 to 1-7.
Figure 5B:
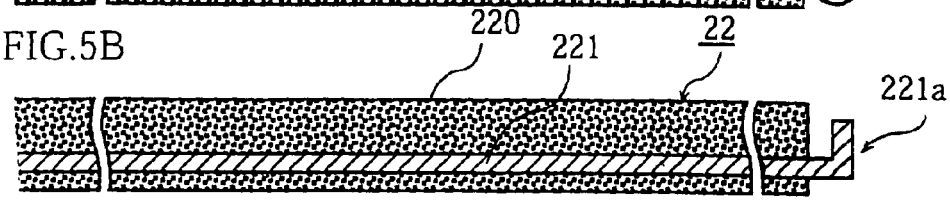
Figure 5C:
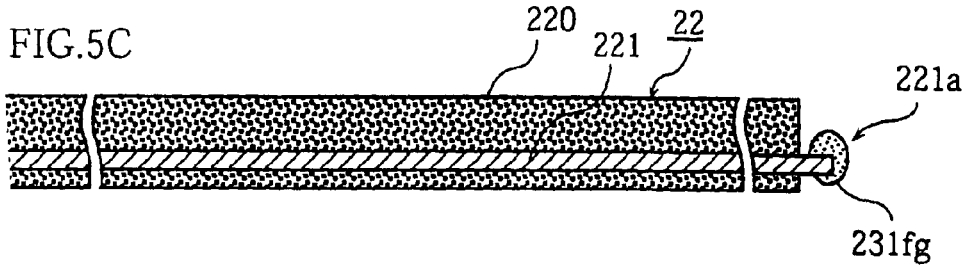
Figure 5D:
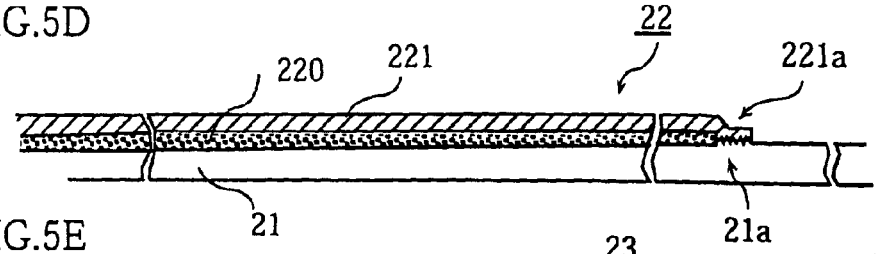
Figure 5E:
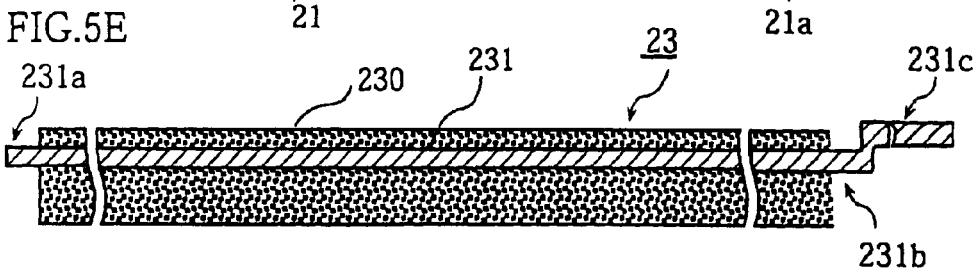
Figure 5E:
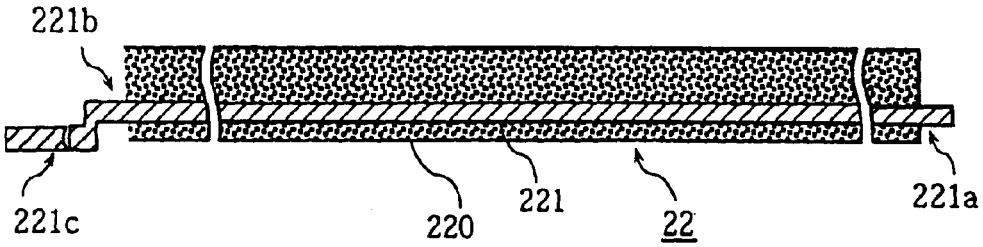

FIGS. 5A to 5E show display electrodes in other variations 1-3 to 1-7 of the first embodiment. FIGS. 5A–5C are partial top views of the display electrode 22 in the variations 1-3 to 1-5, FIG. 5D is a partial cross-section of the display electrode 22 in the variation 1-6, and FIG. 5E is a partial top view of the display electrodes 22 and 23 in the variation 1-7. Though FIGS. 5A–5D only illustrate the display electrode 22, each of these variations can of course be applied to the display electrode 23.

In the variations 1-3 and 1-4 shown in FIGS. 5A and 5B, the end 221*a* of the bus line 221 is shaped respectively in a circle and a rectangle, to widen the area of the end 221*a* that is adhered to the surface of the front panel glass 21. As a result, the adhesion with the front panel glass 21 is strengthened, with it being possible to enhance the effects of the first embodiment.

In the variation 1-5 shown in FIG. 5C, the end 221*a* of the bus line 221 is firmly bonded to the surface of the front panel glass 21 using a frit glass 221*fg* as an adhesive.

In the variation 1-6 shown in FIG. 5D, part 21*a* of the surface of the front panel glass 21 to which the end 221*a* of the bus line 221 is adhered has been sandblasted, to strengthen the adhesion between the end 221*a* and the front panel glass 21.

FIG. 5E is a partial top view of the display electrodes 22 and 23 in the variation 1-7. Usually, the end 221*c* (231*c*) of the bus line 221 (231) at the power supply point serves as a lead (connector) electrode part for electrical connection with the panel drive circuit. Since this lead electrode part 221*c* (231*c*) is less prone to peeling or misalignment, it should be sufficient if the end 221*a* (231*a*) of the bus line 221 (231), which is particularly susceptible to peeling and misalignment, is adhered to the surface of the front panel glass 21. However, in the variation 1-7, all end areas 221*a*–221*c* (231*a*–231*c*) of the bus line 221 (231) are adhered directly to the surface of the front panel glass 21, to further strengthen the adhesion between the display electrode 22 (23) and the front panel glass 21.

2. Second Embodiment

Figure 6:
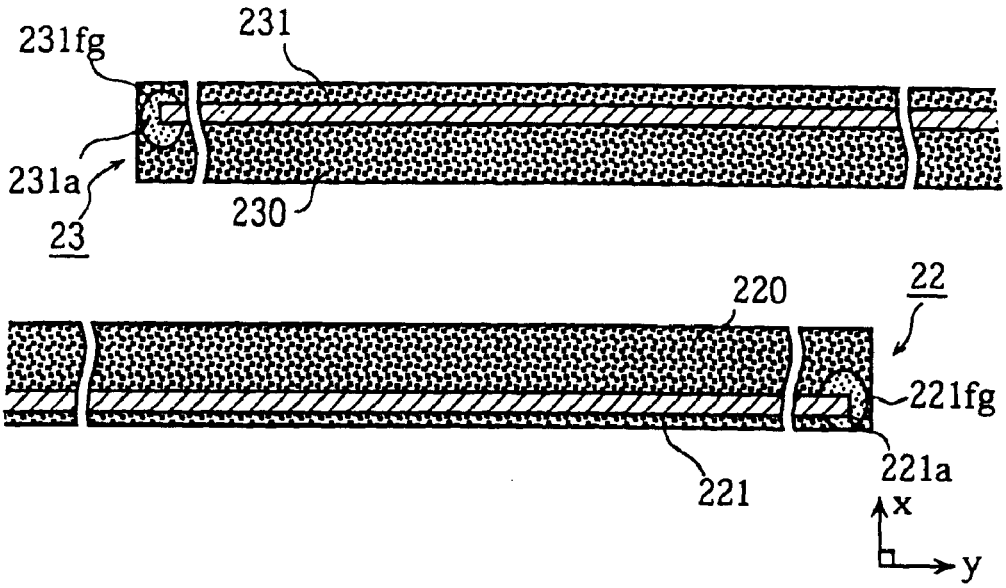
FIG. 6 is a partial top view of display electrodes in a second embodiment of the invention.

FIG. 6 is a partial-top view of display electrodes %22 and 23 in the second embodiment of the invention. In this embodiment, before the formation of the dielectric layer 24, the end 221*a* (231*a*) of the bus line 221 (231) is adhered to the surface of the transparent electrode 220 (230) more firmly than the other parts of the bus line 221 (231), by using the adhesive 221*fg* (231*fg*). This adhesive 221*fg* (231*fg*) is made of the same glass material used for the dielectric layer 24.

With this structure, during the process of forming the bus line 221 (231) and during the subsequent process of forming the dielectric layer 24, the bus line 221 (231) is kept from becoming misaligned or peeling away from the surface of the transparent electrode 220 (230). Accordingly, accurate alignment and configuration of the display electrode 22 (23) are ensured in the complete PDP 10. Such a PDP 10 can produce an excellent image display with balanced light emission in each of the colors.

The adhesive 221*fg* (231*fg*) is not limited to the glass material used for the dielectric layer 24, and other glass materials or organic materials may be used. Here, caution should be exercised when the adhesive 221*fg* (231*fg*) is applied between the bus line 221 (231) and the transparent electrode 220 (230), as applying the adhesive 221*fg* (231*fg*) to too wide an area would increase electrical resistance.

Also, instead of using the adhesive 221*fg* (231*fg*), the end 221*a* (231*a*) of the bus line 221 (231) may be made to contain a higher proportion of glass than the other parts of the bus line 221 (231). In so doing, the bond between the end 221*a* (231*a*) and the transparent electrode 220 (230) is strengthened as in the first embodiment.

3. PDP Manufacturing Method

An example method for manufacturing the PDP 10 in the above embodiments and variations is described below.

3.1. Manufacture of the Front Panel 20

The front panel glass 21 made of soda-lime glass with a thickness of about 2.6 mm is formed by a floating method, and the plurality of pairs of display electrodes 22 and 23 are formed on one surface of the front panel glass 21. To form each pair of display electrodes 22 and 23, first the transparent electrodes 220 and 230 are formed using screen printing (thin film or thick film formation method) and photoetching in the following manner.

Here, it is preferable to coat the surface of the front panel glass 21 with a film of silicon oxide or nitrogen oxide, before forming the plurality of pairs of display electrodes 22 and 23 on that surface. By doing so, the adhesion of the transparent electrodes 22 and 23 to the front panel glass 21 is increased.

3.1.1. Manufacture of the Transparent Electrodes 22 and 23

A photoresist (e.g. an ultraviolet cure resin) of approximately 2.0 $\mu$m in thickness is applied to the entire surface of the front panel glass 21 using screen printing. Then a photomask having a pattern of the transparent electrodes 220 and 230 is fixed to the surface of the front panel glass 21, and ultraviolet light is applied. The result is then soaked in a developing solution to wash off those parts of the photoresist that were not cured.

Following this, a paste containing ITO, an organic material, and a plasticizer that forms the transparent electrode material is applied to the gaps between remaining photoresist parts on the front panel glass 21, and drying, washing, and firing processes are performed in this order. In this way, the transparent electrodes 220 and 230 are formed.

3.1.2. Manufacture of the Bus lines 221 and 231 (Case 1)

In the first embodiment and its variations 1-1, 1-2, 1-3, 1-4, and 1-7, the bus lines 221 and 231 are formed in the following way.

A paste containing Ag, a photoresist, a plasticizer, and a glass material is used as an example bus line material. This paste is applied, using screen printing, to the surface of the front panel glass 21 on which the transparent electrodes 220 and 230 have been formed, and the result is dried. After this, a mask having a predetermined pattern is affixed on the surface, and excess parts of the paste are washed off using photolithography. As a result, the bus lines 221 and 231 having the respective ends 221*a* and 231*a* are formed. In this invention, the bus line material corresponding to the ends 221*a* and 231*a* is bonded to the front panel glass 21 with sufficient adhesion, so that the bus lines 221 and 231 maintain proper alignment without peeling or misalignment, unlike conventional techniques.

In this formation of the bus lines 221 and 231, screen printing may be used instead of photolithography.

3.1.3. Manufacture of the Bus Lines 221 and 231 (Case 2)

In the variation 1-5 of the first embodiment and in the second embodiment, the bus lines 221 and 231 are formed in the following manner.

First, as an example adhesive, a glass material used for the dielectric layer 24 (described later) is melted and dropped onto parts of the surfaces of the transparent electrodes 220 and 230 or parts of the surface of the front panel glass 21 to which the ends 221*a* and 231*a* are to be adhered. Alternatively, the glass material may be dropped over the bus line material, after the bus line material is applied to the surfaces of the transparent electrodes 220 and 230 or the surface of the front panel glass 21.

The bus line material containing Ag, a photoresist, a plasticizer, and a glass material is applied using screen printing to the surface of the front panel glass 21 having the display electrodes 220 and 230, and the result is fired. This firing is done by charging the front panel glass 21 into a kiln that is set to a temperature profile of around 600° C. at the maximum.

Here, a drying process in ordinary temperatures may be performed prior to the firing process.

In this invention, during the operation from the patterning of the bus line material, the firing, to the formation of the dielectric layer 24, sufficient adhesion of the bus line material is maintained by the glass material dropped beforehand. This being so, even if a foreign substance such as a photoresist exists between the bus line material and the transparent electrodes or the bus line material shrinks during drying or firing and is acted upon by deformation stress, the bus line material will not peel away or become misaligned when affected by vibrations from outside. The same effects can be attained by using a method such as sputtering.

3.1.4. Manufacture of the Bus Lines 221 and 231 (Case 3)

In the variation 1-6 of the first embodiment, the bus lines 221 and 231 are formed as follows.

Prior to the application of the bus line material, sandblasting is performed on parts of the surface of the front panel glass 21 to which the ends 221*a* and 231*a* of the bus lines 221 and 231 are to be adhered. The sandblasting is just one example of a process for increasing the affinity between the bus lines 221 and 231 and the front panel glass 21, so that another process such as-ultraviolet irradiation or plasma treatment may be employed. Also, the inventors have found that hydrophilicity treatment has the effect of increasing the adhesion between the bus line material and the front panel glass 21. Accordingly, a thorough cleaning process that at least eliminates organic substances may be performed on parts of the surface of the front panel glass 21 to which the ends 221*a* and 231*a* will be adhered.

After such surface treatment of the front panel glass 21, the bus line material containing Ag, a photoresist, a plasticizer, and a glass material is applied to the surface of the front panel glass 21 on which the transparent electrodes 220 and 230 have been formed, using screen printing (thin film or thick film formation method). The applied bus line material is then subjected to photolithography, as a result of which the display electrodes 22 and 23 are formed.

3.1.5. Manufacture of the Dielectric layer 24

Next, a paste is created from a mixture of a powdery glass substance (e.g. PbO glass) and an organic binder solution (a mixture of 0.2 wt % of homogenol as a dispersant, 2.5 wt % of dibutyl phthalate as a plasticizer, and 45 wt % of ethyl cellulose) at the weight ratio of 55:45. This paste is applied to the entire surface of the front panel glass 21 on which the plurality of pairs of display electrodes 22 and 23 have been arranged, and then fired at 520° C. for 10 minutes. As a result, the dielectric layer 24 with a thickness of about 30 $\mu$m is formed.

3.1.6. Manufacture of the Protective Layer 25

Once the dielectric layer 24 has been formed, the protective layer 25 of magnesium oxide (MgO) with a thickness of about 1.0 $\mu$m is formed on the surface of the dielectric layer 24.

This completes the formation of the front panel 20.

3.2. Manufacture of the Back Panel 26

3.2.1. Manufacture of the Address Electrodes 28 and the Dielectric Film 29

A conductive material with Ag as a main component is applied, using screen printing, at fixed intervals in a stripe pattern to one surface of the back panel glass 27, the latter being formed from soda-lime glass with a thickness of approximately 2.6 mm by floating. This forms the plurality of address electrodes 28, each having a thickness of about 5 $\mu$m.

Next; the same paste used for the dielectric layer 24 is applied at a thickness of about 20 $\mu$m to the entire surface of the back panel glass 27 on which the plurality of address electrodes 28 have been arranged, and then fired, thereby forming the dielectric film 29.

3.2–2. Manufacture of the Barrier Ribs 30 and the Phosphor Layers 31–33

Then, the barrier ribs 30 with a height of about 120 μm are formed in the intervals (approximately 150 μm) between neighboring address electrodes 28 on the surface of the dielectric film 29, using the same kind of glass material as was used for the dielectric film 29. The barrier ribs 30 can be formed, for example, by repeatedly applying a paste containing the aforementioned glass material by screen painting, and then firing the result.

Once the barrier ribs 30 have been formed, phosphor inks including each of red (R), green (G), and blue (B) phosphors are applied in turn to the sides of neighboring barrier ribs 30 and the surface of the dielectric film 29 exposed between the neighboring barrier ribs 30, and then dried and fired to form the phosphor layers 31–33.

An example of the phosphors typically used is as follows.

Red phosphor: $(Y_xGd_{1-x})BO_3:Eu^{3+}$

Green phosphor: $Zn_2SiO_4:Mn$

Blue phosphor: $BaMgAl_{10}O_{17}:Eu^{3+}$ (or $BaMgAl_{14}O_{23}:Eu^{3+}$).

Here, a powder a particle diameter of which is about 3 μm may be used as each of the phosphor materials. Though there are several methods of applying phosphor ink, this invention employs a known method called "meniscus" that discharges phosphor ink from an ultrafine nozzle while forming a meniscus (a bridge by surface tension). This method is effective to coat a desired surface evenly with phosphor ink. However, the invention need not be limited to such a method, and other methods such as screen printing are applicable.

Hence the manufacture of the back panel 26 is completed.

Though the front panel glass 21 and the back panel glass 27 are described as being made of soda-lime glass, this is just one example of a substance that may be used, and other substances are applicable.

3.3. Completion of the PDP 10

The manufactured front panel 20 and back panel 26 are fixed together with sealing glass. The inside of the discharge spaces 38 is exhausted to form a high vacuum (about $8\times10^{-7}$ Torr). The discharge spaces 38 are then filled with a discharge gas of Ne—Xe, He—Ne—Xe, or He—Ne—Xe—Ar, at a certain pressure (500–760 Torr). This completes the PDP 10.

4: Other Considerations

Though the embodiments describe an example of applying the invention to both of the display electrodes 22 and 23, the invention may instead be applied to only one of the display electrodes 22 and 23. To enhance the effects of the invention, however, it is desirable to apply the invention to both of the display electrodes 22 and 23.

Also, the embodiments focus on a front panel glass having display electrodes in a PDP, but the electrode plate of the invention is not limited to such use. The electrode plate may be applied, for example, to a back panel glass having address (scan) electrodes in a gas discharge panel such as a PDP. The electrode plate of the invention may also be applied to a front panel glass having display electrodes in other types of FPDs such as touch panels and LCDs.

Also, the embodiments describe an example in which a VGA-type PDP is manufactured, but of course the invention may be-applied to PDPs or gas discharge panels of other standards.

Also, the embodiments describe an example in which a display electrode is made up of a transparent electrode and a bus line, but a certain degree of effectiveness can be expected even if the invention is applied to a display electrode that is made up of only one of a transparent electrode and a bus line.

Also, a plate on which the electrode is formed may be made of a substance other than glass, although the inventors have found that the invention exhibits maximum effects when an electrode containing Ag is adhered to a surface of a glass plate.

Also, to ensure the effects of the invention, of all ends of the electrode at least an end opposite to an end at a power supply point may be adhered to the surface of the plate with stronger adhesion than the other parts of the electrode.

Further, the electrode need not be strip-shaped (long length) but may take another shape. In such a case, of the ends of the electrode, at least the end opposite to the end at the power supply point is adhered to the surface of the plate with stronger adhesion than the other parts of the electrode.

Also, the embodiments disclose an example of forming an electrode (display electrode) that has a transparent electrode and a bus line respectively as the first and second electrode parts, but the invention should not be limited to such. For instance, an electrode may be formed from two electrode parts made of other types of materials by using screen printing (thin film or thick film formation method).

Although the present invention has been fully described by way of examples with reference to the accompanying-drawings, it is to be noted that various changes and modifications will be apparent to those skilled in the art. Therefore, unless such changes and modifications depart from the scope of the present invention, they should be construed as being included therein.

What is claimed is:

1. An electrode plate for use in a flat panel display, comprising a plate and at least one electrode which is adhered to at least one main surface of the plate, the electrode being made up of (a) a first electrode part which is adhered to the main surface of the plate and (b) a second electrode part which is adhered to the first electrode part so as to be in electrical contact with the first electrode part, characterized in that one side area of the second electrode part in a width direction partially or entirely extends beyond the first electrode part and is directly adhered to the main surface of the plate, with stronger adhesion than the adhesion of other areas of the second electrode part to the first electrode part.

2. The electrode plate of claim 1, wherein the electrode is a display electrode that is made up of a transparent electrode and a bus line respectively as the first electrode part and the second electrode part, and the electrode plate is a front panel glass having a plurality of pairs of display electrodes in a gas discharge panel.

3. A gas discharge panel, comprising the front panel glass of claim 2 having the plurality of pairs of display electrodes.

* * * * *